US006200203B1

(12) United States Patent
Xu et al.

(10) Patent No.: US 6,200,203 B1
(45) Date of Patent: Mar. 13, 2001

(54) ABRASIVE DELIVERY SYSTEM

(75) Inventors: Jian Xu, Plymouth; Kevin D. Otterstatter, New Hope; Jude Lague, Maple Plain, all of MN (US)

(73) Assignee: Jet Edge Division of TM/American Monorail, Inc., Minneapolis, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/237,582

(22) Filed: Jan. 26, 1999

(51) Int. Cl.[7] ..... B24C 7/00
(52) U.S. Cl. ..... 451/99; 451/100
(58) Field of Search ..... 83/53, 177; 451/99, 451/100; 1/101

(56) References Cited

U.S. PATENT DOCUMENTS

| | | | | |
|---|---|---|---|---|
| 554,299 | * | 2/1896 | Parker | 451/100 |
| 1,171,286 | * | 2/1916 | Wadsworth | 451/100 |
| 1,898,689 | | 2/1933 | Ruemelin . | |
| 1,923,329 | | 8/1933 | Ruemelin . | |
| 2,100,366 | * | 11/1937 | Tyler | 137/625.31 |
| 2,726,137 | * | 12/1955 | Davis, Jr. | 502/41 |
| 3,344,524 | | 10/1967 | Kulischenko . | |
| 3,629,976 | | 12/1971 | Carpenter, Jr. . | |
| 3,675,374 | | 7/1972 | Wilder . | |
| 4,183,705 | * | 1/1980 | Kice | 414/221 |
| 4,319,435 | | 3/1982 | Suzuki et al. . | |
| 4,534,139 | * | 8/1985 | Desjardins | 451/101 |
| 4,569,161 | | 2/1986 | Shipman . | |
| 4,862,649 | | 9/1989 | Davis et al. . | |
| 4,970,830 | | 11/1990 | Schlick . | |
| 5,018,670 | | 5/1991 | Chalmers . | |
| 5,146,716 | * | 9/1992 | Lynn | 451/39 |
| 5,407,379 | * | 4/1995 | Shank et al. | 451/101 |
| 5,643,058 | | 7/1997 | Erichsen et al. . | |
| 5,851,139 | | 12/1998 | Xu . | |

FOREIGN PATENT DOCUMENTS

| | | | | |
|---|---|---|---|---|
| 8255 | * | 7/1933 | (AU) | 451/101 |

* cited by examiner

*Primary Examiner*—M. Rachuba
(74) *Attorney, Agent, or Firm*—Haugen Law Firm PLLP

(57) ABSTRACT

A dual-hopper system for liquid/abrasive jet material cutting systems wherein a primary hopper provides a reservoir and source for abrasive particles for mixing with high pressure liquid, and wherein a secondary hopper is interposed between the primary hopper and the nozzle for controlling the flow of abrasive particles from the primary hopper to the nozzle. The secondary hopper comprises a vertically disposed elongated vessel with opposed end walls and with an annular divider plate interposed between the end walls. The annular divider plate is provided with an orifice in the form of an elongated tube which projects into the lower vessel chamber. Particulate material is forced through the tube into the lower chamber, and a column of particles is formed which creates a floating air lock between the chambers. Particulate falls by gravity from the lower chamber and into the cutting head.

9 Claims, 4 Drawing Sheets

ABRASIVE DELIVERY SYSTEM

BACKGROUND OF THE INVENTION

The present invention relates generally to an improved liquid/abrasive jet material cutting system, and more particularly to such a system which provides an improved arrangement for the introduction and/or injection of abrasive particles into the stream of high pressure liquid forming the jet. More specifically, the present invention relates to an improved delivery system for controllably, accurately, and reliably introducing abrasive to a cutting head through which water is being passed for use in creating a liquid/abrasive jet intended for material cutting operations.

High pressure water is frequently utilized in operations for forming cuts in hard or brittle material, and also for the formation of cuts involving unusual or difficult-to-machine patterns. The utilization of water jets for such operations have proved to be highly effective and desirable. In improving these systems for enhancing the utility, speed and effectiveness of the water jets for a variety of applications, abrasive particulate is injected into the fluid flow. However, it is frequently difficult to appropriately and effectively meter the flow of such particulate to the cutting heads, and the present invention provides a system for rendering the metering of such delivery more reliable and effective.

Abrasive delivery systems perform the function of storing and conveying the abrasive particles over varying distances from the storage site for the introduction to the jet. The conveying function is normally achieved through the use of a pneumatic drive. When long distances are involved for the transfer of the abrasive to the jet system, problems may be encountered at the delivery site. In order to more effectively control the flow and hence the delivery, various metering systems have been proposed and utilized. However, present metering systems have not proven to be effective and reliable over periods of time, and improvements are desirable. The present delivery system has proven effective in improving both reliability and accuracy of the delivery system. When so undertaken, the versatility and adaptability of water jet cutting systems is enhanced, and the abrasive-ladened water jet provides a means for cutting through virtually any known material.

SUMMARY OF THE INVENTION

In delivery of abrasive, both fluidized systems as well as solid-phase systems have been employed. The present invention involves an improved solid-phase delivery with a pressurized primary hopper being used to supply an ongoing flow of abrasive to the cutting head or heads. Since working configurations involve single and/or multiple cutting heads, and since each cutting head normally requires individual and separate control, a predetermined abrasive flow through the system to each head may require additional means to maintain and equalize abrasive flow. In this connection, and in accordance with the present invention, a secondary hopper is provided in the delivery tube from the primary hopper, with the features of the secondary hopper providing accurate metering along with reliable on/off control of the abrasive flow. A gate such as a pneumatically actuated slide gate may be provided in order to create reliable on/off control of the abrasive flow. Thus, when the slide gate is opened, abrasive is permitted to fall through a rate control or flow metering means and thence into the cutting head where it is mixed with a flow of high pressure water for creating the actual jet stream. As a further feature of the present invention, the metering means may comprise a rotatable wheel or disc having various sized holes or bores that permit and facilitate change to achieve the desired rate of flow of abrasive to the cutting head.

Therefore, in accordance with the present invention, a liquid/abrasive jet material cutting system is provided which incorporates a suitable pump providing a source of high pressure water or other liquid. A source of abrasive particles is provided which incorporates primary and secondary hoppers, with the primary hopper providing a reservoir and source for abrasive particles which becomes blended in or mixed with the high pressure cutting liquid. The abrasive particulate is conveyed pneumatically from the primary hopper to the secondary hopper, with the secondary hopper serving the dual function of relieving pneumatic pressure build up from the pneumatic conveyor, along with accurately metering the flow of abrasive particulate to the cutting head. In this connection, the flow of abrasive particles is normally directed to a mixing chamber in the cutting head for delivering the coherent high velocity working liquid stream to the surface of the workpiece. The schematic diagram of FIG. 1A illustrates the configuration and/or working arrangement of the major components of a liquid/abrasive jet material cutting system employing the present invention.

The secondary hopper of the present invention is typically in the form of an elongated vessel which defines an enclosure with opposed end walls having an inlet port formed in one end wall and an outlet port in the opposed end wall. An annular divider plate is interposed in the enclosure between the end walls so as to define a pair of chambers including an inlet chamber and an outlet chamber. An orifice is formed in the divider plate for controlling gravitational flow of abrasive particulate from the inlet chamber to the outlet chamber, and also to provide a floating air lock between the inlet and outlet chambers. Since the flow of abrasive from the primary hopper is normally propelled by compressed air, the inlet chamber is generally exposed to a pressure determined primarily by the pneumatic conveyor system. Since this elevated pressure may vary from time to time, depending upon flow conditions, the inter positioning of an air lock has been found to enhance accuracy, consistency and reliability of the abrasive delivery system. The outlet chamber is vented to atmosphere, and hence when the floating air lock is in its open configuration, pressure is relieved from the inlet chamber and the rate of flow into the inlet chamber may be increased. Conversely, when the floating air lock is in its closed configuration, the rate of transfer of compressed air from the inlet chamber to the outlet chamber is retarded, and thus the pressure is free to rise within the inlet chamber, thereby automatically reducing flow of particulate.

The floating air lock is created by positioning a delivery tube in the divider plate, with the delivery tube extending downwardly a finite distance into the outlet chamber. In this arrangement, abrasive particles are transferred from the inlet chamber to the outlet chamber where they free-fall and form a part of a rising column. When it reaches a predetermined height within the outlet chamber, this column of particulate creates an in-situ air lock so as to effectively isolate the inlet and outlet chambers, while permitting constant venting of the outlet chamber to atmosphere. The outlet chamber of the secondary hopper is coupled to a delivery conduit which leads to and is in communication with the mixing chamber of the delivery nozzle from which the working mixture is discharged.

In this arrangement, therefore, the dual hopper system provides effective means of delivering a consistent and controllably regulated flow of abrasive particles to cutting heads, and at the same time provides a means for accommodating the delivery of particulate to the cutting heads under low or atmospheric pressure.

Therefore, it is a primary object of the present invention to provide an improved abrasive delivery system for controllably and reliably metering the flow of abrasive particles into a flow of ultra high pressure liquid for liquid/abrasive jet cutting systems.

It is a further object of the present invention to provide an improved delivery system for conveying abrasive particles from a hopper source in a flow for mixing of the abrasive with ultra high pressure water for the purpose of performing liquid/abrasive jet cutting operations.

It is still a further object of the present invention to provide an improved delivery system for introduction of abrasive particles into a stream of ultra high pressure water, and wherein the delivery of the abrasive particles may be conveyed over relatively long lines or conduits utilizing compressed air, and wherein the particles may be introduced to the nozzle assembly at modest pressures approximating atmosphere.

Other and further objects of the present invention will become apparent to those skilled in the art upon a study of the following specification, appended claims and accompanying drawings.

IN THE DRAWINGS

DESCRIPTION OF THE PREFERRED EMBODIMENT

Figure 1A:
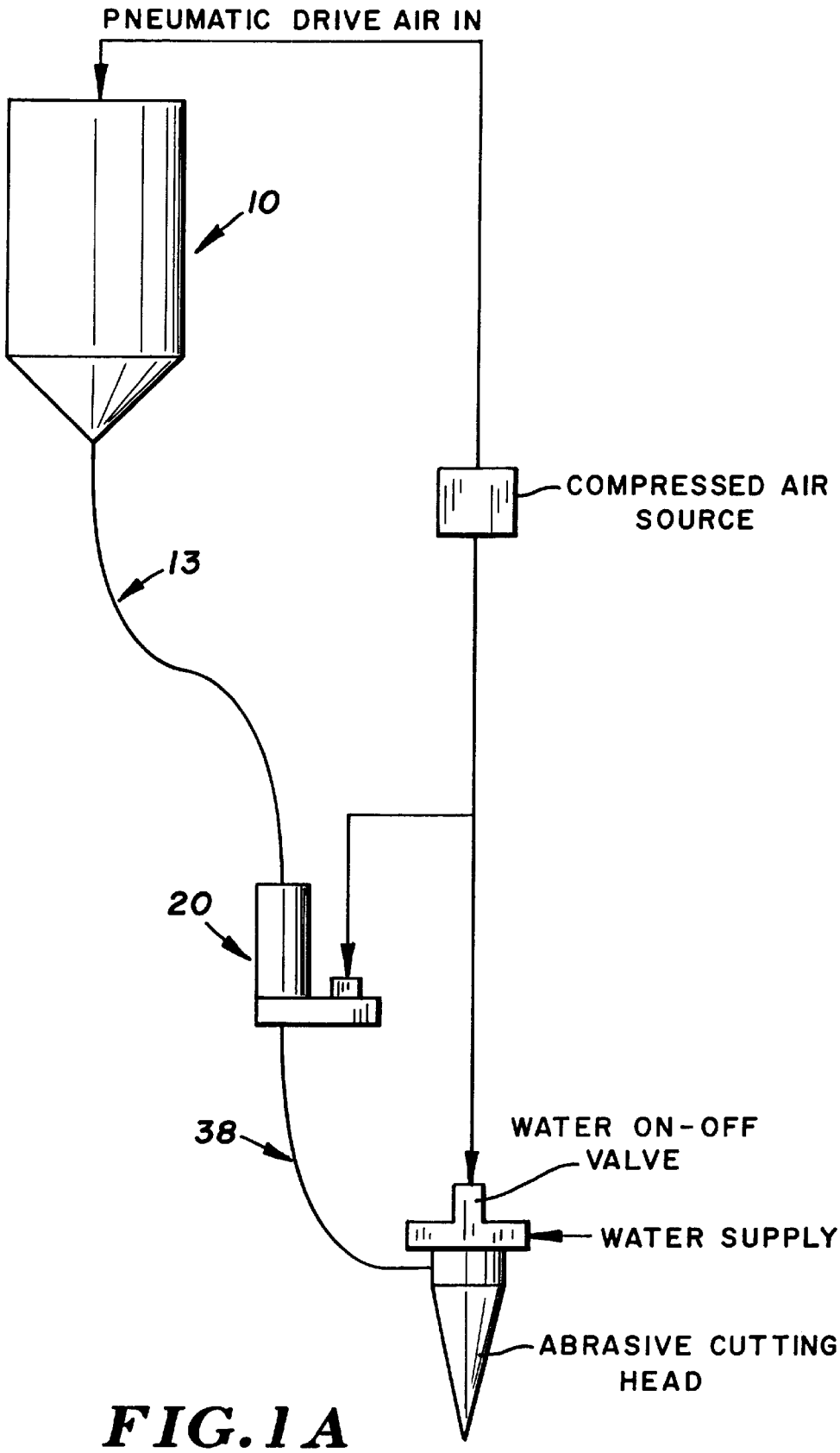
FIG. 1A is a schematic diagram illustrating a typical application system employing the present invention.
Figure 1B:
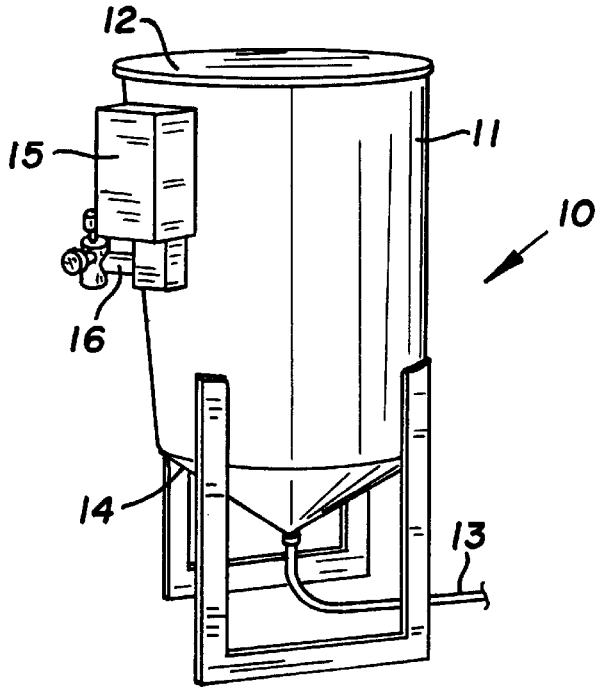
FIG. 1B (PRIOR ART)
FIG. 1B is a perspective view of a typical hopper system utilized for delivery of abrasive particles to a high pressure liquid/abrasive jet cutting system.

In accordance with the preferred embodiment of the present invention, and with particular attention being directed to FIG. 1B of the drawings, the hopper generally designated 10 includes a reservoir such as at drum 11 which is utilized to provide a source of abrasive particles for the high pressure cutting system. Drum 11 is capped by lid 12 at its top and is coupled to outlet conduit 13 through a port formed in the lower conical enclosure 14. Suitable controls are provided as at 15 in order to deliver compressed air or other gas through line 16 into the hopper for pneumatic conveying and delivery of abrasive particles through outlet conduit 13. Thereafter, the abrasive particles enter the mixing chamber of a water jet cutting nozzle where the particles are blended with the water, oriented, and ultimately discharged from the nozzle onto the surface of the workpiece. Such nozzle structures and systems are known in the art, and are disclosed in U.S. Pat. No. 5,018,670, issued May 28, 1991 to Eric J. Chalmers, entitled "CUTTING HEAD FOR WATER JET CUTTING MACHINE" as well as U.S. Pat. No. 5,851,139, issued Dec. 22, 1998 to Jian Xu, entitled "CUTTING HEAD FOR A WATER JET CUTTING ASSEMBLY", and both assigned to the same assignee as the present invention. The disclosures of U.S. Pat. Nos. 5,018,670 and 5,851,139 are incorporated herein by reference.

Figure 2:
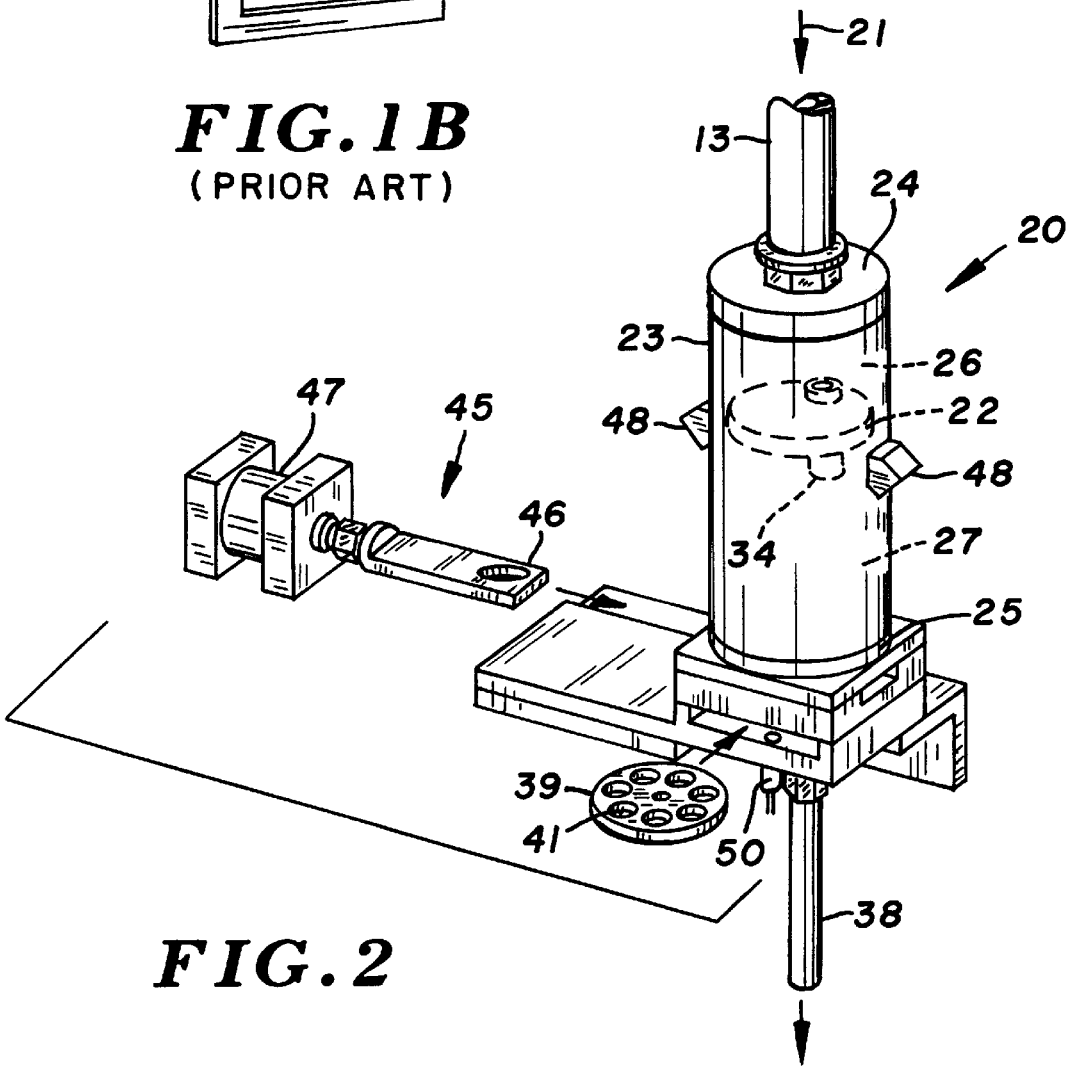
FIG. 2 is a perspective view of a secondary hopper employed in combination with the hopper of FIG. 1, and with certain components of the secondary hopper being shown in exploded position.
Figure 3:
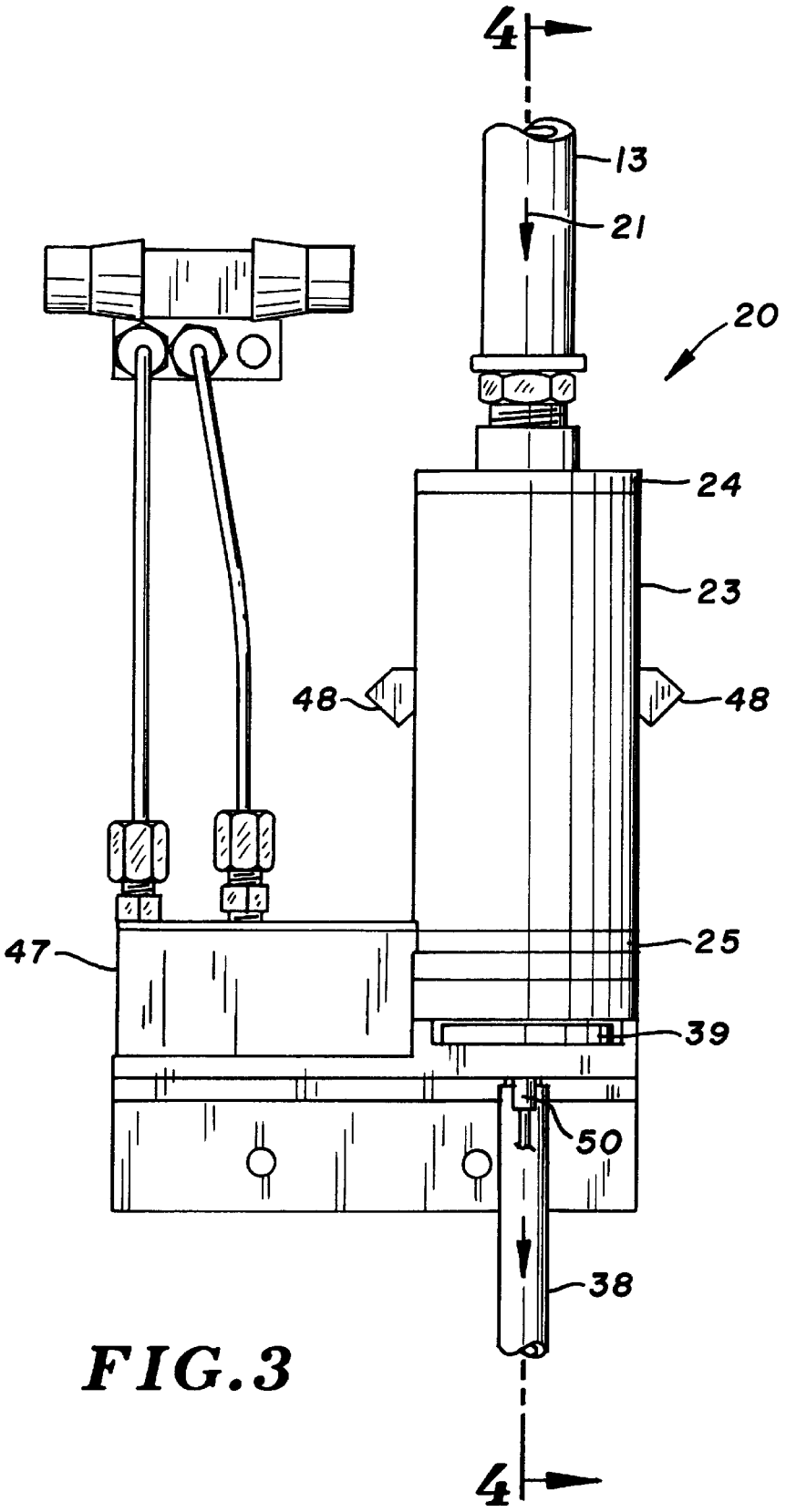
FIG. 3 is a side elevational view of the secondary hopper illustrated in FIG. 2, and further illustrating the configuration of components utilized therein.
Figure 4:
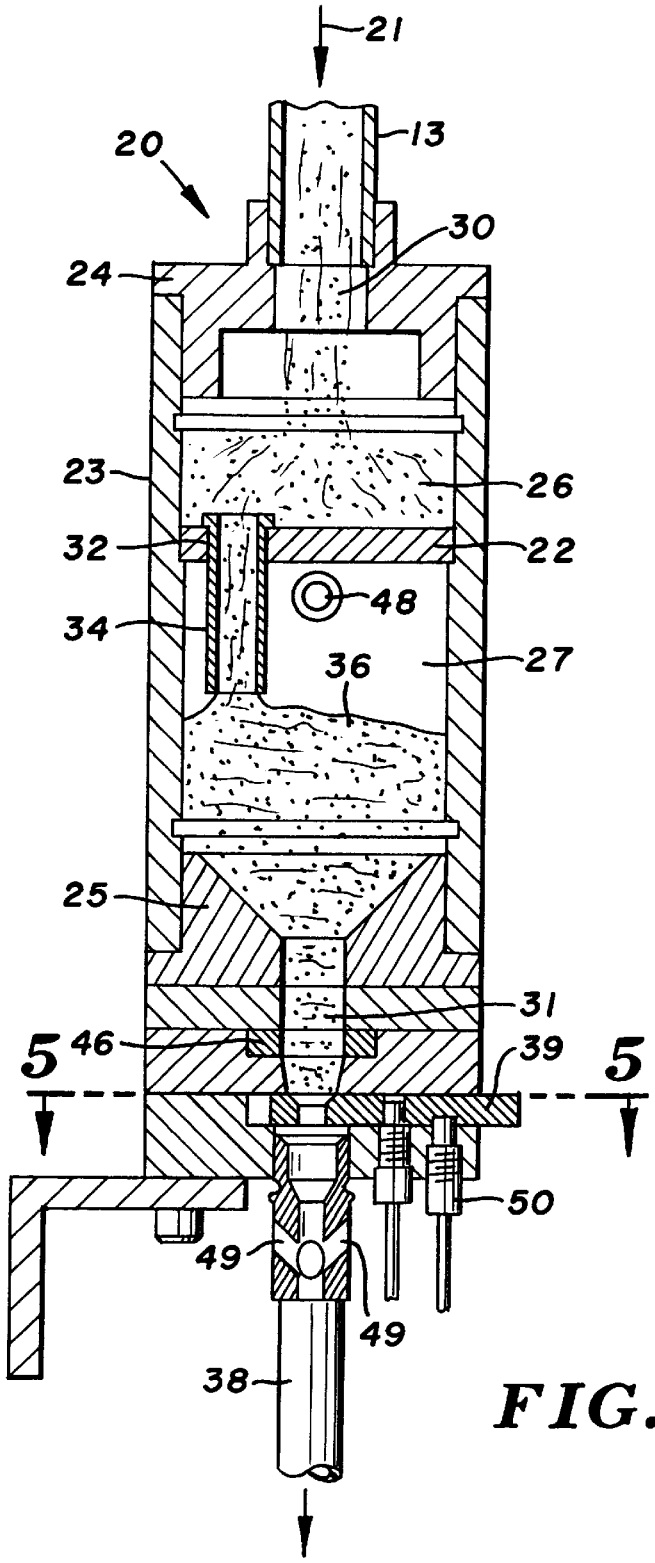
FIG. 4 is a vertical sectional view taken along the line and in the direction of the arrows 4—4 of FIG. 3.

Attention is now directed to FIG. 2 of the drawings wherein certain of the details of the secondary hopper are illustrated. Specifically, secondary hopper generally designated 20 is coupled to conduit 13 for transferring or receiving a flow of abrasive particles from hopper 20, as indicated by arrow designated 21. Enclosure 23, as illustrated, has a longitudinal axis with opposed end walls such as illustrated at 24 and 25. Additionally, and as illustrated in phantom, a generally annular divider plate 22 is interposed in the enclosure to separate the enclosure into an inlet chamber 26 and an outlet chamber 27. An inlet port is formed in the end wall 24, as indicated in FIG. 4 at 30, with an outlet port being formed in the end wall 25, as designated at 31. An orifice is formed in divider plate 22, particularly as shown at 32 in FIG. 4. Delivery tube 34 is coupled to orifice 32 and thus provides a delivery channel directly between inlet chamber 26 and outlet chamber 27. The divider plate 22 together with delivery tube 34 thereby provide for controlled gravitational flow of abrasive particles from the inlet chamber to the outlet chamber where the floating air lock is formed, as described and indicated above.

Abrasive particles collect or build up in a column-like configuration as shown at 36 in FIG. 4. Thus, as abrasive particles enter inlet chamber 26, they are then forced into chamber 27 under compressed air, the transfer being expedited, in part, by the normal presence of an elevated pressure within inlet chamber 26. The elevated pressure occurs as a result of the compressed air being utilized to create flow of particles from the primary hopper 10 to the secondary hopper 20.

Abrasive particles within column 36 pass from outlet chamber 27 through outlet 31 and into abrasive outlet conduit 38 for ultimate delivery to the mixing chamber of a delivery nozzle. As indicated above, the delivery nozzle may be in the form of that illustrated in U.S. Pat. Nos. 5,018,670 and 5,851,139 referred to hereinabove. In this connection, conduit 38 is configured and coupled to the system in order to deliver abrasive particles directly to the mixing chamber of the high pressure liquid nozzle as described in U.S. Pat. Nos. 5,018,670 and 5,851,139 referred to above.

Figure 5:
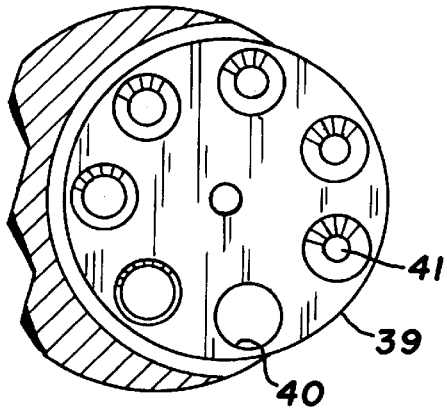
FIG. 5 is a horizontal sectional view taken along the line and in the direction of the arrows 5—5 of FIG. 4, and illustrating the arrangement of the orifice control wheel utilized in the secondary hopper arrangement.

The flow rate of particles delivered from chamber 27 may be accurately metered and controlled by interposing a secondary orifice in the form of orifice control wheel 39. Orifice control wheel, shown in greater detail in FIG. 5, is in the form of a disc having a plurality of openings or bores of varying size formed therein, such as bores 40 and 41. Again, depending upon the requirements or demands of the operation and system, orifices 40 and 41 may be of varying selected sizes so as to permit a preselected amount, and no more than the preselected or desired rate or amount of particulate flow from the build-up of supply column 36 in low pressure outlet chamber into conduit 38. In those circumstances when interruption of flow is indicated, such as when the cutting head is temporarily inactive or out-of-service, a pneumatic slide gate such as is illustrated generally at 45 in FIG. 2 is employed. Pneumatic sliding gate 45 includes a slide-valve or plate 46 (see FIG. 4) which is reciprocably actuated through pneumatic cylinder 47. Actuation or movement of slide gate 45 will serve to intermittently and controllably open and/or close outlet 31 so as to selectively interrupt or otherwise control flow of particulate into line 38.

In order to control the pressure within delivery line 38, separate means are employed as described below. The outlet chamber 27 functions as a low pressure retaining chamber and is vented to atmosphere by means of vent 48. One or more of such vents as at 48 may be provided. Additional vents may be provided adjacent the outlet port from outlet chamber 27, such as those formed along conduit 38 as illustrated at 49—49. Vents 49—49 assist in providing a free and uniform flow of abrasive particles from chamber 27 into the mixing zone or chamber of the nozzle assembly.

In order to selectively position disc or orifice wheel 39, pneumatic indexing means such as illustrated at 50 may be employed to index or controllably position wheel 39 relative to the desired orifice, such as one of the orifices 40, 41, or other radially positioned or disposed orifices as shown within wheel 39. Pin system 51, also pneumatic, aids in centering and retaining disc 39 in place.

It can be seen, therefore, that when the upper extremity of column 36 reaches the base of delivery tube 34, the buildup or column of abrasive particles effectively isolates inlet chamber 26 from outlet chamber 27, thereby creating an effective air lock through which equalization of pressure in chamber 26 is achieved and maintained.

It will be appreciated that the inlet chamber of the secondary hopper is structurally and functionally a continuation of the incoming abrasive feed line. Since it is unvented and subject to the same pressure as feed line 13, the inlet chamber 26 of the secondary hopper is the expanded continuation and end point for the incoming abrasive feed line 13. The delivery tube 34 and the rising column cooperate to perform the function of an on/off feed switch for abrasive particles entering the outlet chamber. The outlet chamber of the secondary hopper forms the abrasive reservoir or buffer chamber for the metering portion of the system comprising metering disc 39 and its associated operative components.

In a typical operating system, each individual cutting head is provided, equipped, and coupled to an independently positioned secondary hopper. In an operating system employing the secondary hopper of the present invention, a single primary hopper may be utilized to deliver abrasive particulate to one or more secondary hoppers, with a single primary hopper typically being able to supply the abrasive particulate requirements for four individual secondary hopper/abrasive cutting head combinations.

It will be appreciated that the specific embodiment shown herein is for purposes of illustration, and is not to be construed as a limitation upon which the present invention is otherwise entitled.

What is claimed is:

1. In a liquid/abrasive jet material cutting system having a pump providing a source of high pressure liquid, a pressurized primary hopper coupled to a source of compressed air and providing a reservoir and pressurized source for abrasive particles for mixing with said high pressure liquid, and a nozzle assembly for mixing said abrasive particles with a flow of high pressure liquid; said system further including a secondary hopper coupled to the outlet of said primary hopper and being interposed between said primary hopper and said nozzle for controlling the flow of abrasive particles to said nozzle, with said nozzle having a mixing chamber coupled to the outlet of said secondary hopper to form a high velocity liquid coherent abrasive loaded liquid stream to a workpiece; said secondary hopper being further characterized in that:

(a) said secondary hopper further comprising a vertically extending elongated vessel defining a cylindrical enclosure having an elongated longitudinally extending axis and with top and bottom opposed end walls and with an inlet port formed in the top end wall and an outlet port formed in the bottom end wall;

(b) a generally annular divider plate interposed in said enclosure intermediate said end walls so as to define a pair of generally coaxially arranged chambers including an upper inlet chamber in fluid-tight communication with said pressurized primary hopper and a lower outlet chamber, and with at least one interchamber orifice being formed in said divider plate for providing continuous controlled flow of abrasive particles under pressure from said pressurized primary hopper through said interchamber orifice from said inlet chamber directly to said interchamber outlet chamber with said interchamber orifice providing communication between said inlet and outlet chambers;

(c) the end wall of said outlet chamber being spaced downwardly from said divider plate along said vertical axis and being configured and positioned to receive and support gravitational and pressurized flow of abrasive particles from said inlet chamber through said interchamber orifice to form a supply column of abrasive particles in said outlet chamber and with said column having a generally conical top formed from delivery and positioning of abrasive from said inlet chamber through said outlet port;

(d) vent means for venting the uppermost portion of said outlet chamber to atmosphere; and (e) the arrangement being such that whenever the upper extremity of the conical top of said supply column reaches the base of said interchamber orifice so as to obstruct the lower end of said orifice by its own presence and without intervention, flow of abrasive particles and pressurized air through said interchamber orifice is interrupted.

2. The system of claim 1 wherein said interchamber orifice and outlet port are radially and axially spaced apart, one from the other.

3. The system as defined in claim 1 being particularly characterized in that said high pressure liquid is water.

4. The system of claim 1 wherein a metering orifice is positioned in said outlet chamber to meter the flow of abrasive particles from said outlet chamber.

5. The system as defined in claim 4 being particularly characterized in that said metering orifice comprises a bore formed in a disc mounted for rotation within said outlet chamber.

6. The system of claim 5 wherein indexing means are provided to rotate said disc.

7. The system as defined in claim 1 being particularly characterized in that auxiliary vent means are interposed in said outlet port.

8. The system as defined in claim 1 being particularly characterized in that valve means are provided in said outlet port for interrupting the flow of abrasive particles from said outlet chamber.

9. The system as defined in claim 8 being particularly characterized in that said valve means is a slide gate having open and closed dispositions, and means are provided for selectively opening and closing said slide gate.

* * * * *

UNITED STATES PATENT AND TRADEMARK OFFICE

CERTIFICATE OF CORRECTION

PATENT NO. : 6,200,203 B1
DATED : March 13, 2001
INVENTOR(S) : Jian Xu, et al.

It is certified that error appears in the above-identified patent and that said Letters Patent is hereby corrected as shown below:

Item (73) Assignee should read — Jet Edge Division of TC/American Monorail, Inc. —.

Signed and Sealed this

Fifth Day of June, 2001

Nicholas P. Godici

NICHOLAS P. GODICI

*Acting Director of the United States Patent and Trademark Office*

*Attest:*

*Attesting Officer*